US006085453A

United States Patent [19]

Volk

[11] Patent Number: 6,085,453

[45] Date of Patent: Jul. 11, 2000

[54] FLAVOR TAG FOR POULTRY AND MEAT

[76] Inventor: Daniel J. Volk, 9400 Nesbit Lakes Dr., Alpharetta, Ga. 90022

[21] Appl. No.: 09/138,828

[22] Filed: Aug. 24, 1998

[51] Int. Cl.[7] ..... G09F 3/16

[52] U.S. Cl. ..... 40/666; 40/637; 24/30.5 S

[58] Field of Search ..... 24/30.5 S, 339, 24/563; 40/316, 637, 658, 666, 617, 673; D20/22

[56] References Cited

U.S. PATENT DOCUMENTS

| | | | |
|---|---|---|---|
| 1,331,654 | 2/1920 | League | 24/563 X |
| 1,512,090 | 10/1924 | Hirtz . | |
| 2,095,195 | 10/1937 | Macdonald . | |
| 2,204,117 | 6/1940 | Brammer | 24/130 X |
| 2,669,047 | 2/1954 | Rieger | 40/637 |
| 2,686,379 | 8/1954 | Moberg . | |
| 2,794,278 | 6/1957 | Percival et al. . | |
| 2,864,188 | 12/1958 | Tierney . | |
| 2,907,586 | 10/1959 | Paxton et al. | 24/30.5 S |
| 3,021,630 | 2/1962 | Swett, Jr. et al. . | |
| 3,067,534 | 12/1962 | Paxton | 40/666 |
| 3,772,809 | 11/1973 | Schneller | 40/637 |
| 4,026,413 | 5/1977 | Britt et al. | 24/30.5 S |
| 4,414,716 | 11/1983 | Stastney | 24/563 X |
| 5,495,645 | 3/1996 | Suzuki et al. | 24/30.5 S |
| 5,498,201 | 3/1996 | Volk . | |
| 5,573,456 | 11/1996 | Benoit et al. . | |
| 5,575,713 | 11/1996 | Benoit et al. . | |
| 5,913,619 | 6/1999 | Lowe | 24/30.5 S X |

*Primary Examiner*—Brian K. Green

*Attorney, Agent, or Firm*—Flehr Hohbach Test Albritton & Herbert LLP

[57] ABSTRACT

A flavor tag (10) including a label portion (12), a C-shaped clamp arm (13), a pair of inwardly projecting prongs (14) defining a gap (15), and a narrow slot (17) and inner opening (18). A string or cross strand on a food product is held within opening (18) and is positioned therein via slot (17). Prongs (14) ensure that the clamp portion of flavor tag (10) remains secured once clamped around the hock of a poultry bird.

8 Claims, 3 Drawing Sheets

FLAVOR TAG FOR POULTRY AND MEAT

TECHNICAL FIELD

The present invention relates to tags applied to poultry and meat products and, more particularly, to tags applied for purposes of identifying or labeling the brand, variety or flavor of the product after it has been processed.

BACKGROUND ART

It is common for poultry products, such as chickens, to be seasoned or flavored prior to packaging. For example, whole processed chickens are often marinated in or seasoned with any of a variety of flavors, such as for example "Italian Style", "Lemon Pepper" and "Barbeque," and then packaged for sale. The idea is to simplify and reduce the amount of preparation required of the final customer, which enhances the appeal of the product. After seasoning or marinating, the appropriate tag is applied to the chicken to identify its flavor. Other purposes for applying tags to poultry and meat products, as well as other types of food products, include identification of the brand and/or the variety of the product.

Another technique used by processors to identify poultry products is to secure the appendages of the product with a large string, which has a pre-punched tag secured previously thereto by the tag manufacturer. Once the string and tag are secured to the appendages, the poultry is seasoned and packaged. This too works fine, as long as the bird is properly seasoned after the tag is attached to the bird, and as long as there is no need to change the tag. Should a bird receive flavoring that differs from the tag, the string needs to be untied, a new tag threaded onto the string, and the string resecured to the legs and wings of the bird. As sometimes happens, an order of poultry birds may change after the tags have been applied but prior to seasoning. In this case, the strings need to be untied to allow a new tag to be secured to the string. Because use of a string and tag can be cumbersome, some food processors avoid problems by slitting the thigh skin of a whole bird and tucking the appendages under the skin.

Furthermore, it is sometimes desired by stores to prepare their own seasonings and marinades and for these stores it is preferable to separately provide pre-labeled tags that can be secured to the birds after flavoring at the store.

U.S. Pat. No. 5,498,201 discloses an earlier retainer design of mine that secures together the hocks of a poultry bird. It was common to color code the retainer or imprint labels thereon to indicate characteristics such as flavoring of the bird. However, the retainer of my '201 patent was used solely for securing the hooks and also does not have room thereon for labeling the product.

The present invention is directed toward providing an improved tag that is easily secured and removed from a poultry, meat or other type of food product after flavoring and cooking and that is flexible to allow for easy attachment by several means.

DISCLOSURE OF INVENTION

Briefly described, the present invention comprises a tag for a food product and includes a flexible clamp portion adapted to clamp to an appendage of the product by flexible movement of the clamp around the appendage, a label portion for providing identifying indicia on the tag, and a narrow slot with an enlarged inner opening for receiving a string tied around the appendages of the product in a manner that secures the tag to the string.

According to an aspect of the invention, the enlarged inner opening of the slotted portion is sized to closely receive the string and the narrow slot is narrower than the inner opening so that once the string is positioned within the enlarged inner opening, the string is held therein due to frictional resistance provided by the narrow slot. This allows for easy attachment of the flavor tag to commonly used strings and netting material.

Preferably, the flexible clamp portion is substantially C-shaped to conform with a generally round appendage of the product. In this manner, the C-shaped clamp can clamp around the hock or other appendage, such as a wing, of a poultry bird and can be securely held thereon during shipping and handling.

According to another aspect of the invention, the narrow slot and enlarged inner opening are provided in one of the legs of the C-shaped clamp. However, other positions for the slot and opening are feasible, such as in the label portion of the flavor tag.

According to another aspect of the present invention, the tag includes a lead-in to the narrow slot, to guide the string into the inner opening. The lead-in has gradual contours to the slot both to ensure that the string is properly guided thereto and to prevent undesired snagging of the tag on the food product or packaging.

Preferably, the tag is relatively flat so that a plurality of tags can be stacked in an efficient configuration. An efficient stacking arrangement allows for easy shipping of the tags and also may provide for easy dispensing of the tags.

According to another aspect of the invention, the flexible clamp includes a gap for inserting the clamp over an appendage of the food product. The gap is defined by a smooth contoured lead-in that makes it easier to slide the tag onto an appendage of the food product. In addition, the clamp portion includes a pair of inwardly projecting prongs for grasping the food product. The prongs, in part, define the lead-in, making it easy to clamp the tag onto an appendage, yet project inwardly to prevent the tag from inadvertently releasing or separating from the appendage.

These and other features, objects, and advantages of the present invention will become apparent from the following description of the best mode for carrying out the invention, when read in conjunction with the accompanying drawings, and the claims, which are all incorporated herein as part of the disclosure of the invention.

BRIEF DESCRIPTION OF THE DRAWINGS

Throughout the several views, like reference numerals refer to like parts, wherein.

BEST MODE OF CARRYING OUT THE INVENTION

Reference will now be made in detail to the preferred embodiments of the invention, examples of which are illustrated in the accompanying drawings. While the invention will be described in conjunction with the preferred embodiments, it will be understood that the described embodiments are not intended to limit the invention specifically to those embodiments. On the contrary, the invention is intended to cover alternatives, modifications and equivalents, which may be included within the spirit and scope of the invention as defined by the appended claims.

Figure 1:
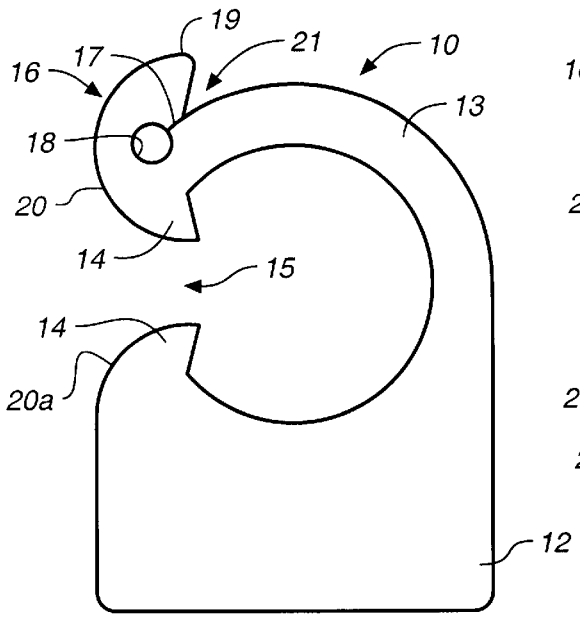
FIG. 1 is a plan view of a first embodiment of the flavor tag of the present invention.

FIG. 1 shows a first embodiment of a flavor tag 10 of the present invention. Flavor tag 10 includes a label portion 12 where identifying indicia can be placed, such as the brand, variety or flavor of the product to which the tag is to be secured. A C-shaped clamp arm 13 extends from label portion 12 to form a C-shaped clamp with the label portion that acts as a flexible clamp adapted to clamp to an appendage of a meat or poultry product. A pair of inwardly projecting barbs or prongs 14 define a gap or opening 15 through which the hock of a whole chicken, for example, can move to secure the flavor tag to the chicken product. Prongs 14 also allow for attachment to other appendages and food product parts.

Tag 10 also includes a pair of smooth contoured lead-in surfaces 20, 20*a*, which partially define opening 15 and make it easier to slide tag 10 onto an appendage of a poultry bird, such as onto a hock.

Flavor tag 10 is made from a material that is suitable for use at cooking temperatures, which can approach and exceed 500° F. An example of a suitable material is heat stabilized nylon 6/6. Other types of temperature resistant plastics and other materials can also be used. An advantage of the present invention is that the tag can be attached to the food product during cooking, which allows the tag to be secured prior to cooking, when identification is easier and more reliable.

As used herein, the term "flavor tag" is used to refer to the tag of the present invention but is not meant to limit the scope of the present invention to tags used solely to identify flavor of product. As stated previously, the identifying indicia can indicate other features of the food product, such as for example brand and variety.

The distal end 16 of clamp arm 13 includes an outwardly projecting prong 19 that defines a slot 17 and an inner, enlarged opening 18. Slot 17 and opening 18 are provided for receiving a string or netting (not shown) or the like used to secure the appendages of a food product. Prong 19 and clamp arm 13 define a similar leadin notch 21 that is designed to guide a string into slot 17 and further into inner opening 18. Also, prong 19 has smooth, rounded edges in order to prevent snagging of the tag.

Figure 2:
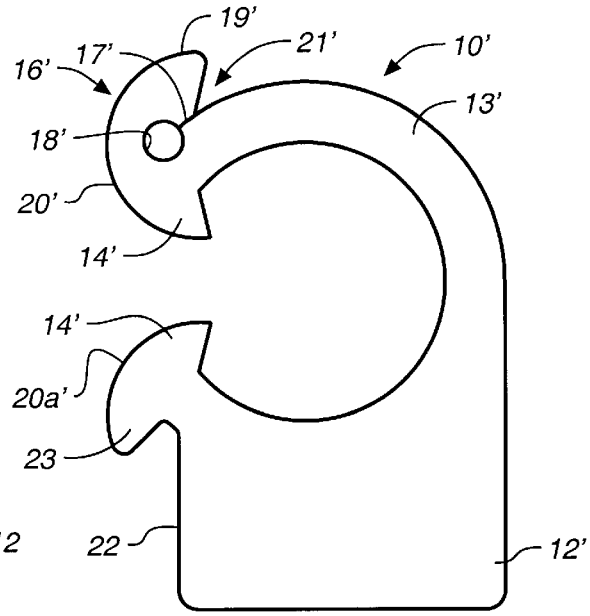
FIG. 2 is a plan view of a second embodiment of the flavor tag of the present invention.

FIG. 2 shows a second embodiment of a flavor tag 10' that is identical to the tag of FIG. 1 except that label portion 12' has reduced dimensions due to the elimination of a front section of material, which creates an instep 22 that defines a head 23, part of which includes inwardly projecting prong 14'. A reduced area label portion 12' is provided when less indicia is needed to identify the food product. Otherwise, the tags of FIGS. 1 and 2 function the same.

Figure 3:
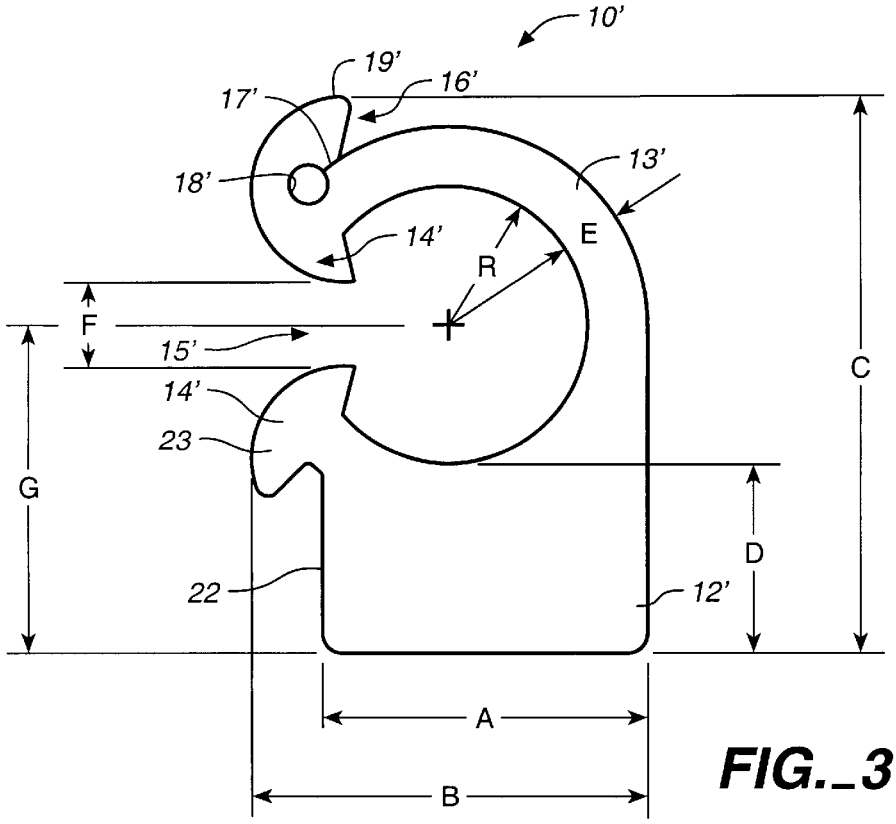
FIG. 3 is a plan view like FIG. 2 showing various dimensions of the tag.

Referring to FIG. 3, various dimensions of an exemplary sized flavor tag 10' are illustrated. The width A of label portion 12' is 0.875 inches; the width B of the entire flavor tag is 1.062 inches; the height C of the flavor tag is 1.490 inches; and the height D of label portion 12' is 0.500 inches. The width E of clamp arm 13' is 0.160 inches and the radius R of the clamp arm is 0.750 inches. The width F of gap 15 is 0.230 inches and the distance G from the center of clamp arm 15' to the bottom of label portion 12' is 0.875 inches.

Figure 4:
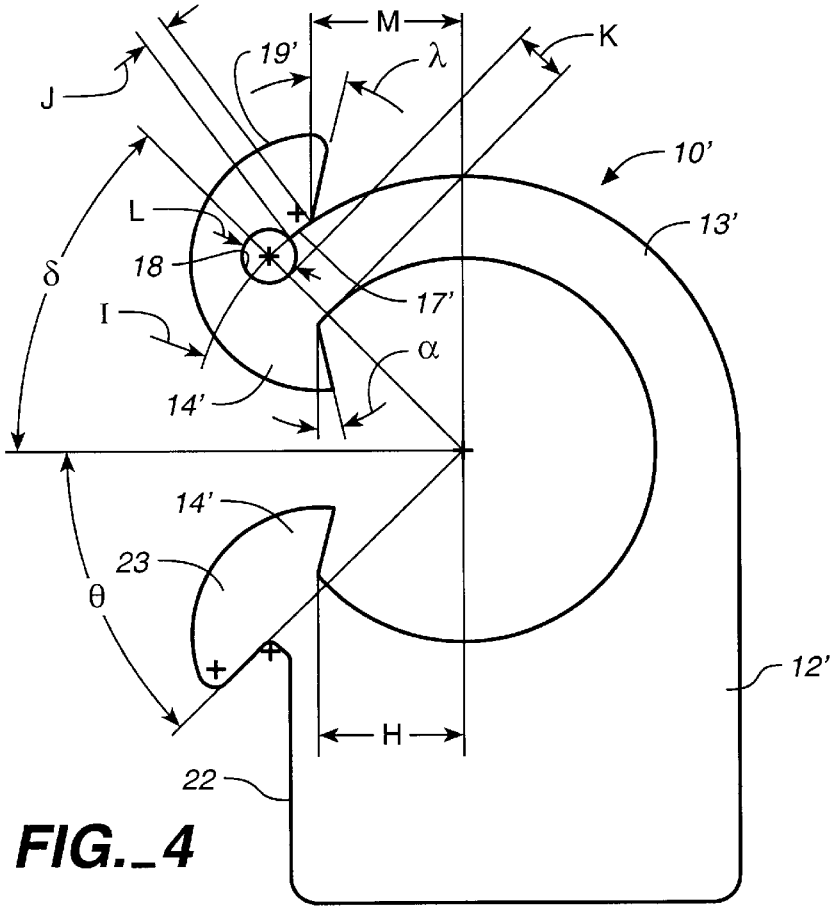
FIG. 4 is an enlarged plan view of the flavor tag of FIG. 2 showing additional dimensions of the tag.

In FIG. 4, additional dimensions are illustrated for flavor tag 10'. Provided herein are dimensions for the following parts of the flavor tag:

width H=0.286
radius I=0.535
length J=0.050
width K=0.105
radius L=0.109
width M=0.297 and degrees for the following angles:

angle $\theta$=45
angle $\delta$=45
angle $\lambda$=15
angle $\alpha$=15

Figure 5:
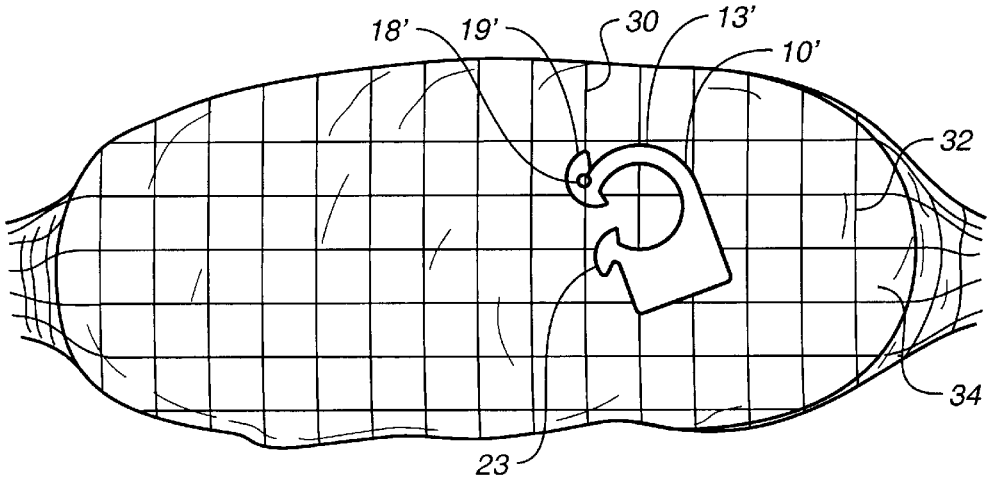
FIG. 5 is a side view of a generic meat or poultry product encased in a netting mesh with the flavor tag of FIG. 2 secured to the mesh.

Referring to FIG. 5, flavor tag 10' is secured to a cross strand 30 of a mesh netting 32 that encloses and is used for retaining together a food product 34. Cross strand 30 extends through inner opening 18' and, due to the contact of outward prong 19' and cross arm 13', is held within opening 18', thus securing flavor tag 10' to the netting. When secured, the flavor tag is free to dangle from the netting, but may if desired be further secured and held stationary by hooking barb 23 into an adjacent cross strand.

Figure 6:
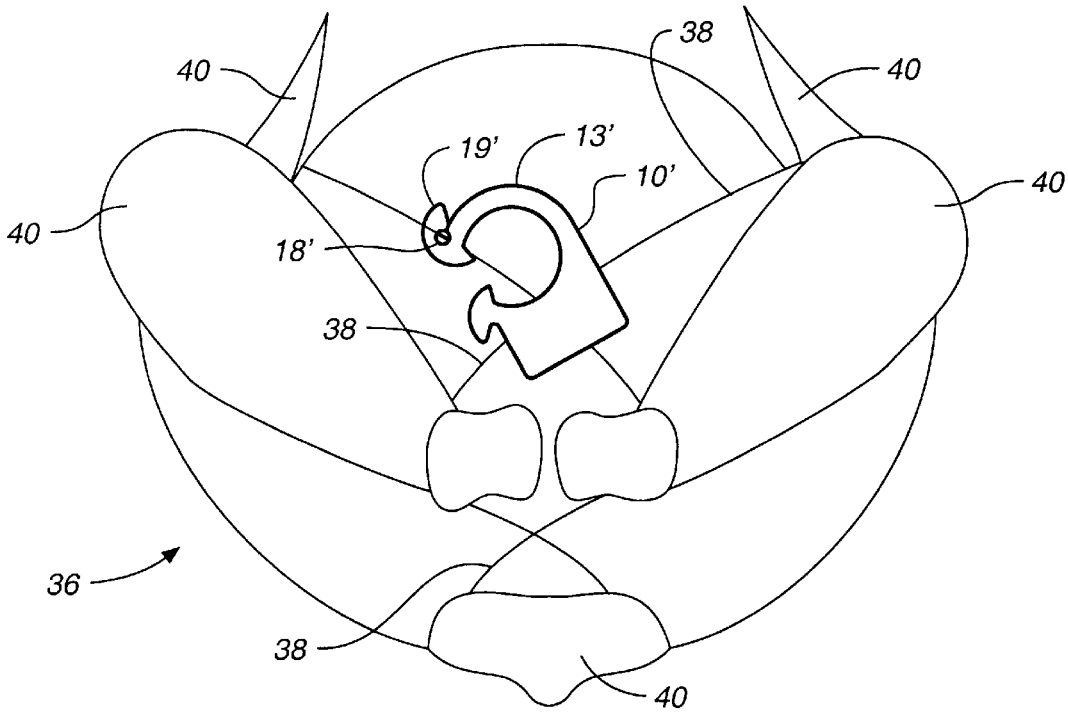
FIG. 6 is an end view of a whole chicken with the appendages of the chicken secured by string and with the flavor tag of FIG. 2 secured thereto.

FIG. 6 illustrates a whole chicken or turkey 36 that has a string 38 secured around appendages 40 to hold the appendages tightly against the body of the bird. The particular string pattern used to secure appendages 40 is not germane to the present invention, for the flavor tag can be secured to any exposed segment of string. Flavor tag 10' is secured to string 38 in the same manner as shown and discussed with reference to FIG. 5. Sting 38 is slid through the narrow slot and positioned within inner opening 18', and the flavor tag is otherwise allowed to dangle. Again, the closed contact of prong 19' and cross arm 13' prevents the tag from slipping off of the string.

With either the netting of FIG. 5 or the string of FIG. 6, the enlarged inner opening 18' of the slotted portion of the flavor tag is sized to closely receive the string (or cross strand) and the narrow slot 19' is narrower than the inner opening, and preferably closed, so that once the string is positioned within the enlarged inner opening, the string is held therein due to frictional resistance or closure provided by the narrow slot.

Figure 7:
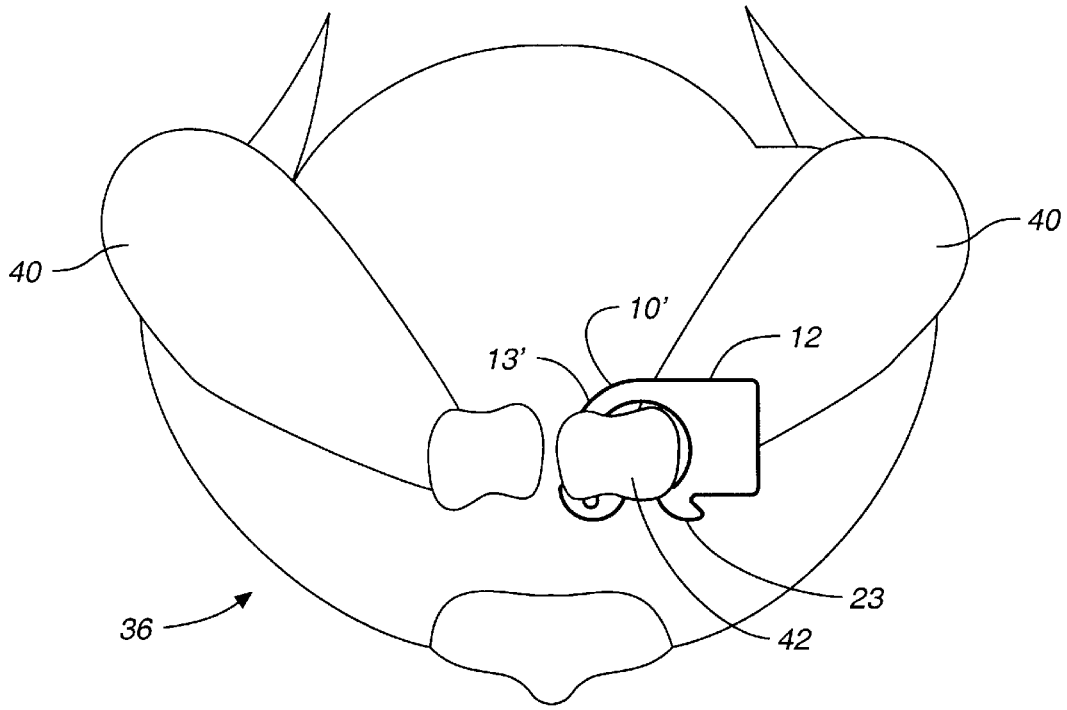
FIG. 7 is an end view of the whole chicken of FIG. 6 with the flavor tag of FIG. 2 secured at one of the hocks of the bird.

Alternatively, as shown in FIG. 7, flavor tag 10' can be secured around the hock 42 of a leg appendage 40 by clamping the flavor tag onto the narrow leg section short of hock 42. In this position, label portion 12' of flavor tag 10' is prominently displayed and can be easily read for the information contained thereon. Flavor tag 10' can also be secured in a similar fashion to a wing or other appendage and for this, it may be desirable to provide a clamp arm that is oblong in shape rather than substantially circular as shown.

Accordingly, the tag of the present invention is versatile in how it is attached to the food product and can be attached in many ways that all position the label portion prominently for viewing. Furthermore, the tag is easily removable should it be necessary to replace the tag for any reason, without having to remove the string or re-truss the appendages of the bird.

The flavor tag of the present invention provides customers with great flexibility in preparing food products. For example, because the tag is easily applied either to a string, netting or appendage, the tags can be applied later in the processing of the food product. A customer can apply the tags prior to placing whole birds on spits for baking in a rotisserie oven, which makes it easy for the customer to keep different flavored birds separate while cooking.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto when read and interpreted according to accepted legal principles such as the doctrine of equivalents and reversal of parts.

The invention claimed is:

1. A substantial planar tag for a food product which has at least one appendage and has at least one string attached thereto, said tag comprising a label portion having a substantially rectangular shape, an arcuate arm having a proximal and a distal end extending from a first corner of said label portion upwardly and inwardly from said first corner and then generally downwardly toward a second corner of said label portion, said second corner being formed with a first prong, said arcuate arm having a terminus formed with a second prong spaced from said first prong by a gap through which said appendage may be forced to clamp said tag on said appendage, said terminus being formed with an opening spaced away from said first prong relative to said label portion, said terminus being formed with a slot extending into said opening from an edge of said terminus.

2. The tag of claim 1 wherein, the opening of the terminus is sized to closely receive the string and the slot is narrower than the opening so that once the string is positioned within the opening, the string is held therein due to frictional resistance provided by the slot.

3. The tag of claim 2 wherein, the arcuate arm and first prong together substantially C-shaped to conform with a generally round appendage of the product.

4. The tag of claim 1 wherein, the tag includes a lead-in to the slot, to guide the string into the inner opening.

5. The tag of claim 1 wherein, the tag is made from a material capable of withstanding food cooking temperatures.

6. The tag of claim 1 wherein, the arcuate arm and first prong include a pair of inwardly projecting barbs for grasping the food product.

7. The tag of claim 6 wherein, the barbs are inwardly projecting in a manner that grabs the food product when the tag is placed onto the food product thereby preventing the tag from separating from the food product.

8. A tag according to claim 1 in which said slot defines an extension of the curvature of said edge of said arcuate arm.

* * * * *